US009307870B2

(12) United States Patent
Gould

(10) Patent No.: US 9,307,870 B2
(45) Date of Patent: Apr. 12, 2016

(54) SOAP STAND

(71) Applicant: James Gould, Memphis, TN (US)

(72) Inventor: James Gould, Memphis, TN (US)

( * ) Notice: Subject to any disclaimer, the term of this patent is extended or adjusted under 35 U.S.C. 154(b) by 0 days.

(21) Appl. No.: 14/625,507

(22) Filed: Feb. 18, 2015

(65) Prior Publication Data

US 2015/0282677 A1 Oct. 8, 2015

Related U.S. Application Data

(60) Provisional application No. 61/976,467, filed on Apr. 7, 2014.

(51) Int. Cl.

| | |
|---|---|
| ***A47G 29/00*** | (2006.01) |
| ***A47K 5/05*** | (2006.01) |
| ***C11D 17/04*** | (2006.01) |

(52) U.S. Cl.

CPC ..... *A47K 5/05* (2013.01); *C11D 17/041* (2013.01); *Y10T 29/49826* (2015.01)

(58) Field of Classification Search

CPC ..... A47K 5/05; A47K 5/02; A47K 5/04
USPC ..... 248/176.1, 684, 546, 547; 206/77.1, 206/204; 211/85.12; 510/152
See application file for complete search history.

(56) References Cited

U.S. PATENT DOCUMENTS

| | | | | |
|---|---|---|---|---|
| 2,457,918 A | | 1/1949 | Pierce | |
| 3,019,548 A | | 4/1959 | Nadler | |
| 2,922,248 A | | 1/1960 | Kocsi | |
| D197,503 S | | 2/1964 | Benton | |
| 3,196,112 A | | 7/1965 | Presley | |
| D230,934 S | | 3/1974 | McGruden | |
| D247,999 S | | 5/1978 | Whatley | |
| D249,207 S | | 9/1978 | Emmer | |
| D272,875 S | | 3/1984 | Johnston | |
| 4,530,479 A | | 7/1985 | Chen | |
| 4,948,079 A | | 8/1990 | Baeta | |
| D312,740 S | * | 12/1990 | Greenhut | D6/536 |
| 5,029,802 A | * | 7/1991 | Ali | A47K 5/05 206/77.1 |
| D492,527 S | | 7/2004 | Snell | |
| D547,583 S | | 7/2007 | Dretzka | |

(Continued)

OTHER PUBLICATIONS

Soap Saver product, published at www.amazon.co.uk published at least as early as Mar. 1, 2015.

(Continued)

*Primary Examiner* — Todd M Epps
(74) *Attorney, Agent, or Firm* — Peter L. Brewer; Baker Donelson IP

(57) ABSTRACT

A stand for a bar of soap is provided. The stand is designed to be selectively attached to an off-the-shelf bar of soap, and to then support the bar of soap over a support surface such as a counter top or a soap dish. The stand defines a base having an upper surface and an opposing lower surface. The stand also includes a plurality of through-openings formed through the base. The stand additionally includes a plurality of spikes that are placed along the upper surface of the base. The spikes are dimensioned to extend into the bar of soap when the base is compressed against a substantially flat surface of the bar of soap, and to hold the plate adjacent to the bar of soap. Finally, that stand has one or more tabs residing along the lower surface of the base. The tabs are dimensioned to support the base and a connected bar of soap above a support surface. A method of supporting a bar of soap above a support surface is also provided herein.

24 Claims, 8 Drawing Sheets

(56) References Cited

U.S. PATENT DOCUMENTS

| | | | | |
|---|---|---|---|---|
| 8,523,125 | B1 * | 9/2013 | Jardine | A47K 5/04 206/77.1 |
| 2005/0211575 | A1 * | 9/2005 | Li | A47K 5/04 206/77.1 |
| 2008/0169208 | A1 * | 7/2008 | Li | A47K 5/05 206/77.1 |

OTHER PUBLICATIONS

Soap Saver product, published at www.dollartree.com published at least as early as Mar. 1, 2015.
Soap Saver product, published at www.angelspage.wordpress.com published Oct. 10, 2011.
Soap Saver product, published at www.homedepot.com published at least as early as Mar. 1, 2015.

* cited by examiner

SOAP STAND

CROSS REFERENCE TO RELATED APPLICATIONS

This application claims the benefit of a U.S. provisional patent application filed Apr. 7, 2014, having U.S. Ser. No. 61/976,467. That application was entitled "Soap Stand," and is incorporated herein by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The present invention relates to devices used for washing and personal hygiene. More specifically, the invention relates to devices used to support a bar of soap for keeping the soap dry when not in use.

2. Technology in the Field of the Invention

It is known virtually worldwide to use a bar of soap for washing. Millions of people use soap every day for the washing of hands and body. The traditional bar of soap comprises a dry material that becomes a surface acting agent (or "surfactant") when applied to human skin with water. The soap is generally made by treating vegetable or animal oils and fats with a strongly alkaline solution.

After a bar of soap has been used, it is common to place the bar of soap on a counter or in a soap dish. However, this creates a problem as a pool of water tends to collect on the counter or in the dish after the bar of soap has been used. Moreover, the bar tends to retain and even absorb at least a small amount of water while it sits in the pool, causing the soap to become gooey. This "goo" becomes a source of soap loss. Over the life of a bar of soap, it is estimated 15 to 20% of soap volume may disintegrate, slough off the bar, or be lost down a drain due to this condition.

To avoid this problem, some have created soap dishes having ridges along a bottom surface. The soap is placed on top of the ridges in the dish, allowing the soap to rest above any pool of water that may form between uses. However, not all dishes have such ridges. Further, the ridges tend to create only very shallow trenches, meaning that in some cases the bar of soap is still in contact with water. In addition, moisture residing on or in the bar can become trapped along the soap dish ridges.

To avoid these issues, many manufacturers have begun providing soap in liquid form, wherein the soap is dispensed from a container using a pump. In the U.S. and Europe, liquid soap has become a significant portion of soap sales. However, for several reasons liquid soap has a higher environmental impact than bar soap, not the least of which is that liquid soap requires several times more energy for raw material production and 20 times more energy for packaging production than bar soap. Further, liquid soap tends to be more expensive than bar soap. Additionally, liquid soap is heavier and more voluminous than bar soap on a per-wash basis. As a result, shipping requires more space and more fuel to transport the same number of cleanings. It is also observed that empty liquid soap containers add several million pounds of plastic trash each year.

Accordingly, a need exists for a device that replaces the traditional soap dish or, alternatively, that supplements the soap dish. Further, a need exists for a device that may be selectively attached to any bar of soap, and then used as an integral soap stand to support the bar of soap over any pool of water that may arise in a soap dish or on a counter top.

BRIEF SUMMARY OF THE INVENTION

A stand for a bar of soap is provided herein. In one aspect, the stand is designed to be selectively attached to an off-the-shelf bar of soap, and to then support the bar of soap over a support surface such as a counter top, a bathtub ledge or a soap dish.

The stand first comprises a base. The base has an upper surface and an opposing lower surface.

The stand may further include a plurality of through-openings formed through the base. The through-openings are dimensioned to allow air to access the bar of soap through the base. Stated another way, a degree of ventilation is provided.

The stand also includes a plurality of spikes, or teeth. The spikes are placed along the upper surface of the base. The spikes are dimensioned to extend into the bar of soap when the base is compressed against a substantially flat surface of the bar of soap, and to hold the base adjacent to the bar of soap. In one aspect, the teeth are actually rounded undulations. In another aspect, the teeth define hooks that enter the soap easily but make it difficult to extract the base.

The stand additionally has one or more tabs. The tabs reside along the lower surface of the base. The tabs are dimensioned to support the base and a connected bar of soap above a support surface. In one aspect, the tabs are in the form of undulating parallel supports that run the length of the base. The supports are configured to be conducive to fingers fitting/gripping the stand.

In one aspect, the base comprises a substantially flat plate. The plate may be fabricated from a pliable material such as a flexible plastic. Alternatively, the plate may be fabricated from a substantially rigid material such as a hard plastic, a ceramic or a metal. In any instance, the plate preferably has dimensions that are smaller than the flat surface of the bar of soap.

In one aspect, the one or more tabs comprises a plurality of rubber or elastomeric tabs. In another aspect, the one or more tabs comprises a plurality of plastic buttons.

In one embodiment, the base comprises a hollow plastic body that floats in water. The base may be in the form of an aesthetic shape that is pleasing to a child, such as a frog, a cow, a duck, a whale or a dinosaur.

A method of supporting a bar of soap above a support surface is also provided herein.

BRIEF DESCRIPTION OF THE DRAWINGS

So that the manner in which the present invention can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 4A presents a side, cross-sectional view of the soap stand and the bar of soap. The view is taken across a major axis of the bar of soap.

FIG. 4B is another cross-sectional view of the soap stand and bar of soap of FIG. 4A. Here, the cut is taken across a minor axis of the bar of soap.

FIG. 4C is a bottom view of the soap stand and the bar of soap. Four illustrative tabs are visible.

FIG. 5A presents a top view of the soap stand.

FIG. 5B is a side view taken across the major axis of the soap stand.

FIG. 5C is another side view, taken across a minor axis of the soap stand.

FIG. 5D is a bottom view of the soap stand. Four illustrative tabs are again visible.

DETAILED DESCRIPTION

Definitions

As used herein, the term "bar of soap" means any solid cake of surfactant material.

DETAILED DESCRIPTION OF CERTAIN EMBODIMENTS

Figure 1A:
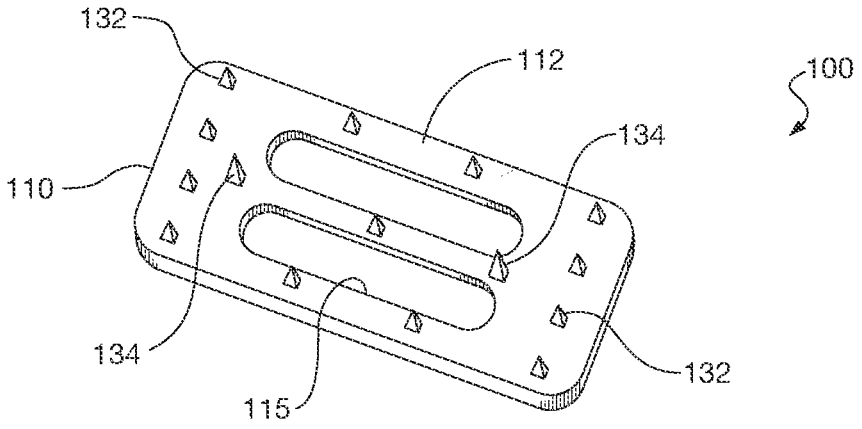
FIG. 1A is a perspective view of a soap stand of the present invention, in one embodiment. In this view, an upper surface of the soap stand is seen.
Figure 1B:
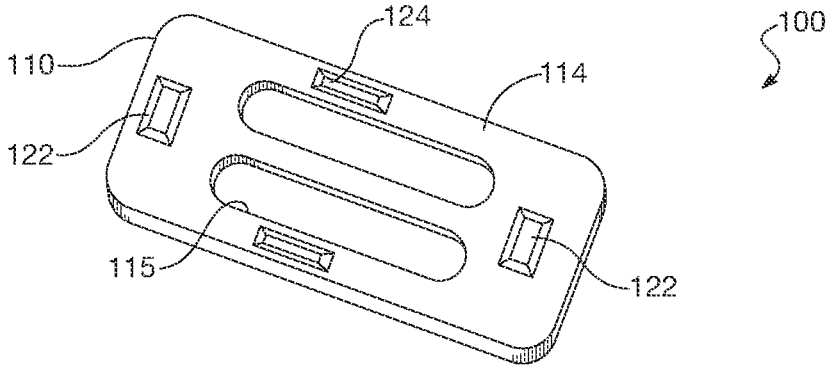
FIG. 1B is another perspective view of the soap stand. Here, a lower surface of the soap stand is seen.

FIGS. 1A and 1B provide perspective views of a soap stand 100 of the present invention, in one embodiment. In FIG. 1A, an upper surface 112 of the soap stand 100 is seen. In FIG. 1B, a lower surface 114 of the soap stand 100 is seen. The soap stand 100 will be introduced with reference to FIGS. 1A and 1B together.

The soap stand 100 first includes a base 110. In the arrangement of FIGS. 1A and 1B, the base 110 comprises a substantially flat plate 110. The plate 110 defines the upper surface 112 and the lower surface 114. The plate 110 is preferably fabricated from a substantially rigid material such as a hard polycarbonate material, a ceramic material, or metal. However, in another embodiment the plate 110 is fabricated from a more flexible plastic or elastomeric material, or has integral flex points for engaging a radial surface.

It is preferred that the plate 110 be fabricated from a low-density material that will float in water. In this case, the density will be less than 1 g/cm$^3$. It is also preferred that the plate 110 be fabricated from a bright color, although the plate 110 is not limited to any particular color.

In the arrangement shown in FIGS. 1A and 1B, the plate 110 has a rectangular profile. However, in another embodiment the plate 110 may have a more oval shape, or may have a diamond shape, or may be shaped as a star. The plate 110 is not limited to any particular shape so long as it has enough surface area to adequately support a bar of soap while allowing the soap to "wear away" at the corners.

It is preferred that the plate 110 include a plurality of through-openings. In the arrangement of FIGS. 1A and 1B, a pair of elongated through-openings 115 are shown. However, it is understood that these are merely illustrative and that any number or arrangement of through-openings 115 may be provided. The through-openings allow air to access a bar of soap (seen at 200 in FIG. 2) when the bar of soap is affixed to the stand 100.

The soap stand 100 also includes one or more tabs 122, 124. The tabs 122, 124 reside along the lower surface 114 of the plate 110. The tabs 122, 124 are dimensioned to support the plate 110 and a connected bar of soap 200 on a support surface. In the arrangement of FIGS. 1A and 1B, the tabs 122, 124 are fabricated from a rubber or elastomeric material. This prevents the soap stand 100 from slipping on the support surface. However, the tabs 122, 124 may be fabricated from the same material as the plate 110.

In one aspect, tabs are arranged as loops to receive fingers. In another aspect, tabs are spaced so that fingers may be received between selected tabs to enable gripping.

A support surface is not shown in FIGS. 1A and 1B. However, a support surface is shown at 300 in FIG. 3, discussed below.

In the arrangement of FIG. 1B, tabs 122 are placed along the minor axes of the plate 110, while tabs 124 are placed along the major axes of the plate 110. Tabs 122 have a greater width than tabs 124. However, all of the tabs 122, 124 have the same height.

It is understood that the lower surface 114 may have more of tabs 122 or more of tabs 124, or fewer of tabs 122 or fewer of tabs 124. It is also understood that either or both of tabs 122, 124 may have a circular (or arcuate) profile or a polygonal profile.

The soap stand 100 further includes a plurality of spikes 132, 134, or teeth. The spikes 132, 134 extend from the upper surface 112 of the plate 110. Preferably, the plate 110 and the spikes 112 are integral, being formed through a plastic injection molding process. Optionally, the tabs 122 are also integral as part of the same injection molding process.

In the arrangement of FIG. 1A, the spikes 132 reside along a perimeter of the plate 110, while the spikes 134 reside along an interior of the plate 110. Each of the interior spikes 134 has a height that is greater than that of each of the anterior spikes 132. However, the height of all of the spikes 132, 134 is sufficient to allow the spikes to extend into a bar of soap 200 when the plate 110 is compressed against a flat surface of the bar, thereby affixing the bar of soap 200 to the stand 100. Further, it is understood that a series of spikes having just one height may be used.

Figure 2:
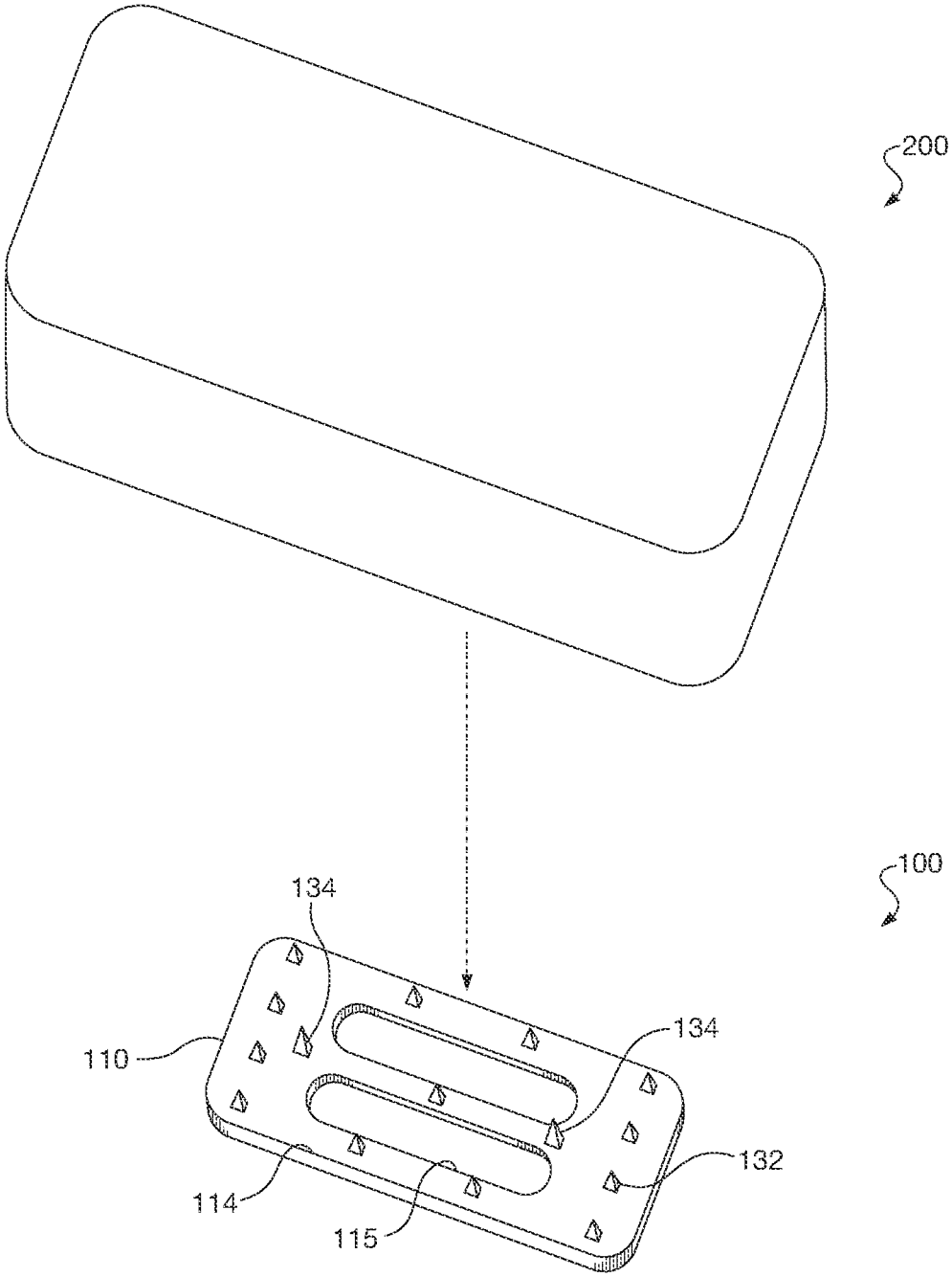
FIG. 2 is an enlarged perspective view of the soap stand of FIG. 1A. Here, the soap stand is shown with a bar of soap in exploded-apart relation.

FIG. 2 is an enlarged perspective view of the soap stand 100 of FIG. 1A. Here, the soap stand 100 is shown with the bar of soap 200 in exploded-apart relation. It is observed that the dimensions of the plate 110 of the stand 100 are smaller than the dimensions of the bar of soap 200. The soap stand 100 will continue to support the soap 200 even as the soap 200 slowly disintegrates over time as a result of use.

Figure 3:
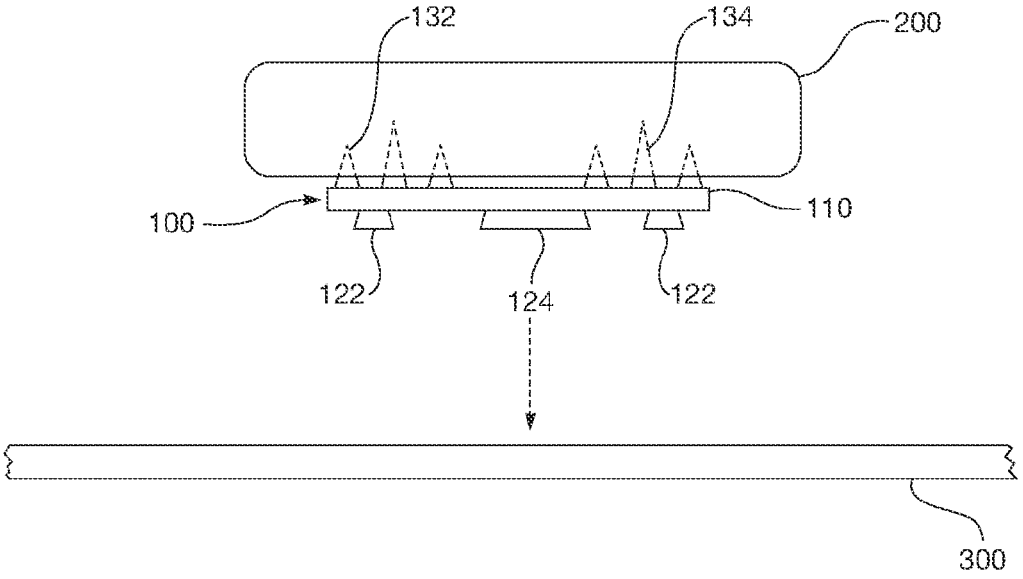
FIG. 3 is a side view of the soap stand and bar of soap of FIG. 2. Here, the soap has been affixed to the stand.

FIG. 3 is a side view of the soap stand 100 and bar of soap 200 of FIG. 2. Here, the soap 200 has been affixed to the stand 100. The connection is by means of the spikes 132, 134, or "teeth." The spikes 132 may be, for example, about ¼" in length, while spikes 134 may be, for example, about ⅜" or even ½" in length. It is understood that the invention is not limited to any particular dimension of spikes unless expressly stated in the claims.

In the view of FIG. 3, the spikes 132, 134 are shown extending into the bar of soap 200. The portions of the spikes 132, 134 that enter the bar 200 are shown in phantom. Also of interest, the stand 100 and supported bar 200 are shown above a support surface 300. The support surface 300 may be, for example, a counter top in a bathroom or kitchen. Alternatively, the support surface 300 may be a bottom surface of a soap dish.

The soap stand 100 with soap 200 may be sold commercially as an integral unit. This means that the soap stand 100 comes pre-implanted to the soap 200.

Figure 4A:
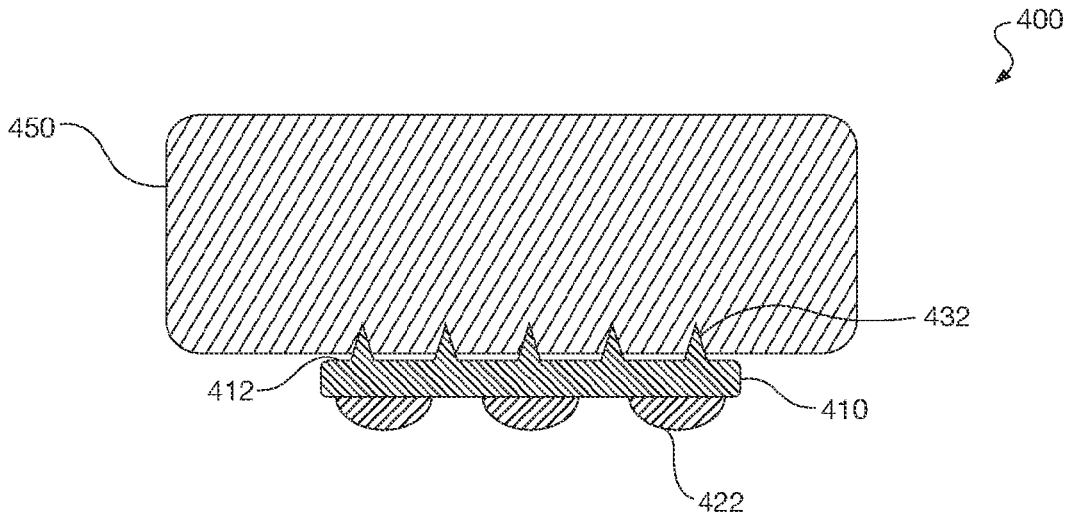
FIGS. 4A, 4B and 4C present a soap stand in an alternative embodiment. In each Figure, a bar of soap has been affixed to the soap stand.
Figure 4B:
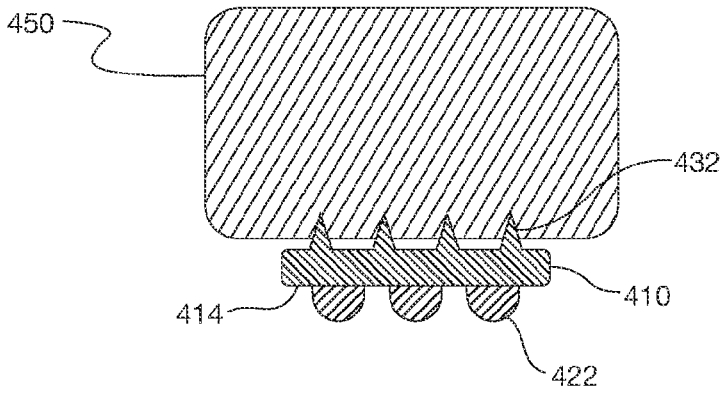
Figure 4C:
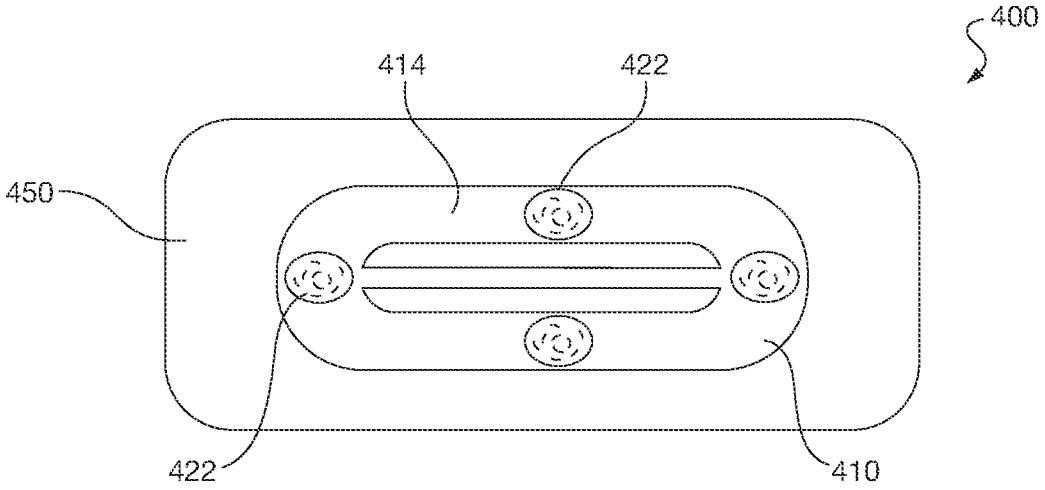

FIGS. 4A, 4B and 4C present a soap stand 400 in an alternative embodiment. In each figure, a bar of soap 450 has been affixed to the soap stand 400.

FIG. 4A presents a side, cross-sectional view of the soap stand 400 and the bar of soap 450. The view is taken across a major axis of the bar of soap 450.

The soap stand 400 includes an elongated base 410. In one aspect, the base 410 is hollow, allowing the soap stand 400 and connected bar of soap 450 to float according to Archimedes' Principle. The soap stand 400 is supported by a plurality of tabs 422 that extend from an under surface 414 of the stand 400. The soap stand 400 also includes a plurality of teeth 432 that extend up into the bar of soap 450.

FIG. 4B is another cross-sectional view of the soap stand 400 and bar of soap 450 of FIG. 4A. Here, the view is taken across a minor axis of the bar of soap 450.

FIG. 4C is a bottom view of the soap stand 400 and bar of soap 450 of FIG. 4A. Four illustrative tabs 422 are visible.

The soap stand 400 and the soap 450 may be sold as separate objects or products. In this instance, the user or manufacturer will physically attach the stand 400 to the soap 450 through force. In this respect, the spikes or teeth 432 are urged up into the body of the bar of soap 450. In another aspect, the soap stand 400 is sold integral to and already connected to the soap 450.

FIGS. 5A, 5B, 5C and 5D present a soap stand 500 in yet another an alternative embodiment. Here, the soap stand 500 presents a parabolic body 510. The body 510 is, in one aspect, two inches in length (along a major axis) and one inch in width (along a minor axis). The soap stand 500 includes a plurality of spikes 532 dispersed along on an upper surface 512, and a plurality of pads 522 arranged on a lower surface 514.

Figure 5A:
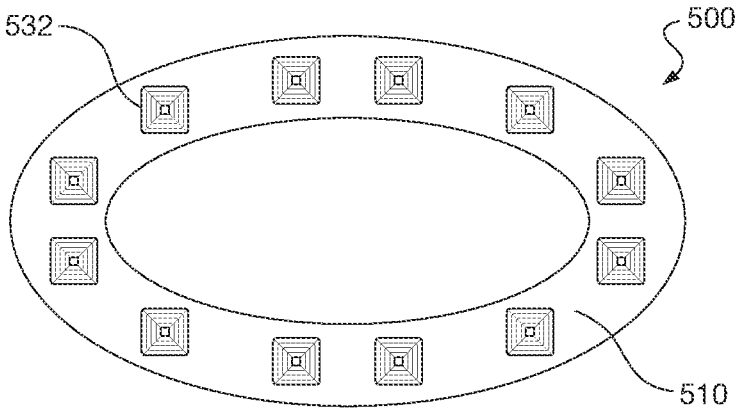
FIGS. 5A, 5B, 5C and 5D present a soap stand in yet another an alternative embodiment. Only the stand is shown.

FIG. 5A presents a top view of the soap stand 500. Here, a plurality of spikes 532 are seen. The spikes 532 are distributed generally equi-distantly about the upper surface 510 of the body 510. Each spike 532 has a base having a diameter of about 5/32", and extends upward to a point. In one aspect, the spikes 532 are about 8/32" in height, and are separated at the bases at about 6/32" increments.

An open area, referred to as a ring 515, is preserved within the parabolic body 510. The ring 515 may have a width of about 20/32" within the internal diameter, and a length of about F. The width of the body 510 around the inner diameter is about 12/32".

Figure 5B:
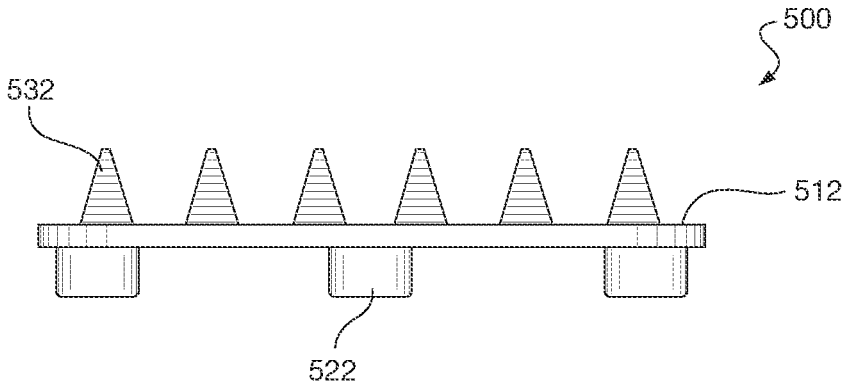
Figure 5C:
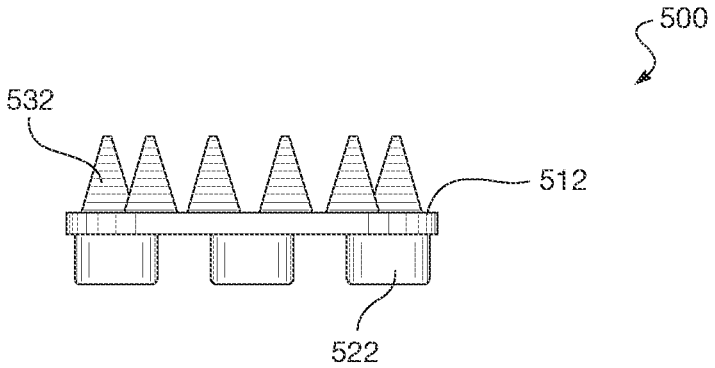

FIG. 5B is a side view taken across the major axis of the soap stand 500. FIG. 5C is another side view, taken across a minor axis of the soap stand 500. In each view, both spikes 532 and pads 522 are visible.

Figure 5D:
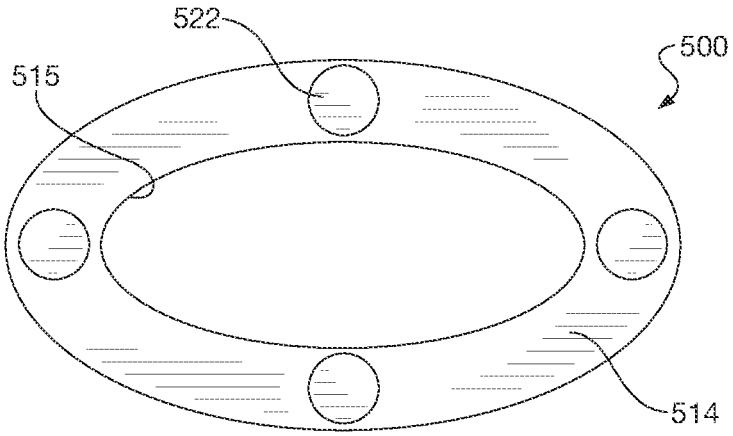

FIG. 5D is a bottom view of the soap stand 500. Four illustrative tabs 522 are again visible. In the arrangement of the FIG. 5 series of drawings, the tabs 522 are placed at opposite ends of the major and minor axes, respectively. However, it is understood that the tabs 522 may be disposed in other locations. The body 510 and tabs 522 create a platform from which soap residue and water can drain from a bar of soap, eliminating the 'goo' that develops from soap staying wet, being in contact with water. This, in turn, extends the life of the soap bar.

As can be seen, an improved soap stand is provided, in various arrangements. The soap stand allows a child or a user with arthritic hands to more easily grasp and hold on to the soap as it will stay dry between uses. In one aspect, the stand also enables the bar of soap to float. In addition, the soap stand allows the user who is living in a dormitory or staying at a camp or in a prison having a common shower to identify their own soap.

Advantageously, the soap stand attaches to the bar, as opposed to soap dishes. The soap stand may be used at a sink counter, a shower bench, a dormitory shower, a guest bath, and so forth.

The soap stand can be customized with specific logos, names or colors. The soap stand with its teeth is arranged to hold onto the bar of soap even as the bar disintegrates over time due to use. While it may be that a small central portion of the soap becomes difficult to use at the end of the bar's life, it is also observed that the soap has stayed dry between uses, thereby actually extending its life. In addition, once the soap has declined into a small central portion, that remaining portion is easily removed for the last bit of use, allowing the soap handle to be re-used on a fresh bar of soap later.

In one aspect, the soap stand is made of a single piece of injection molded plastic, and is 2¼" long×1¼" wide×1" high, fitting a standard 3½"×2½"1" bar of soap. Small teeth extend from the surface on the soap side, alternating from ¼" to 1/16", and located ¼" from the edge. The teeth will sink into the soap with modest pressure, especially if the bar is slightly wet. In one design, the handle is usable from either the side (finger or fingers through the center space) or lengthwise (fingers on both sides of the center bar, under the crosspiece).

A smaller size may be offered for children or for personal bars of soap as offered in hotels, hostels and camps.

In one aspect, the teeth are coated with a dissolvable material. In this way, as the bar of soap dissolves and the teeth become exposed, an edges to the teeth dissolve, leaving smooth nubs. In another aspect, the soap stand also includes a spindle that extends completely through the bar of soap. A cap is snapped in place on the opposite side of the soap to hold the handle more securely in place. In another aspect, the stand is adhered to the soap during the manufacturing process for the soap.

While it will be apparent that the inventions herein described are well calculated to achieve the benefits and advantages set forth above, it will be appreciated that the inventions are susceptible to modification, variation and change without departing from the spirit thereof.

I claim:

1. A stand for a bar of soap, comprising:

a base having an upper surface and an opposing lower surface;

a plurality of spikes placed along the upper surface of the base, wherein the spikes are dimensioned to extend into the bar of soap when the base is compressed against a substantially flat surface of the bar of soap, and to hold the base adjacent to the bar of soap;

a plurality of tabs placed along the lower surface of the base, wherein each of the tabs is dimensioned to support the base and a connected bar of soap above a support surface.

2. The stand of claim 1, wherein the base comprises a substantially flat plate.

3. The stand of claim 2, wherein the plurality of spikes comprises:

a first set of spikes residing along a perimeter of the plate; and a second set of spikes residing along an interior of the plate;

wherein each of the spikes in the second set of spikes has a height that is greater than a height of each of the spikes in the first set of spikes.

4. The stand of claim 2, wherein the plate has dimensions that are smaller than dimensions of the flat surface of the bar of soap.

5. The stand of claim 1, wherein each tab of the plurality of tabs is an elastomeric tab.

6. The stand of claim 1, wherein each tab of the plurality of tabs comprises a plastic button.

7. The stand of claim 1, wherein the base comprises a hollow body that floats in water.

8. The soap stand of claim 1, fabricated from an injection molding process or a 3D printing process.

9. The soap stand of claim 1, further comprising:

a plurality of through-openings formed through the base.

10. The soap stand of claim 1, wherein each of the spikes comprises:

a substantially smooth base prong fabricated from a rubber material; and a surface coating around the base prong forming a pointed spike that is dissolvable in water.

11. The soap stand of claim 1, wherein the base has a density that is less than the density of fresh water.

12. The soap stand of claim 1, wherein the base comprises a ring dimensioned to receive a finger of a user.

13. The soap stand of claim 1, wherein at least two selected tabs of the plurality of tabs are spaced apart so that a user's fingers may reside between the selected tabs during use.

14. A method of supporting a bar of soap above a support surface, comprising:

providing a bar of soap, the bar having a substantially flat surface;

providing a support stand, the stand having:

a base having an upper surface and an opposing lower surface, a plurality of spikes placed along the upper surface of the base, and a plurality of tabs placed along the lower surface of the base;

pressing the base against the flat surface of the bar of soap, thereby forcing each of the plurality of spikes to extend into the bar of soap and holding the base against the bar of soap;

placing the base and connected bar of soap onto a support surface, wherein the base and the bar of soap are supported above the support surface by the tabs.

15. The method of claim 14, wherein in providing the support stand, the base comprises a substantially flat plate.

16. The method of claim 14, wherein in providing the support stand, the base has dimensions that are smaller than dimensions of the flat surface of the bar of soap.

17. The method of claim 14, wherein in providing the support stand, each tab of the plurality of tabs comprises a plastic button.

18. The method of claim 14, wherein in providing the support stand, each tab of the plurality of tabs is at least ½" in height.

19. The method of claim 14, wherein in providing the support stand, the base comprises a hollow body that floats in water.

20. The method of claim 14, wherein in providing the support stand further comprises a plurality of through-openings formed through the base.

21. The method of claim 14, wherein in providing the support stand, each of the spikes comprises:

a substantially smooth base prong fabricated from a rubber material; and a surface coating around the base prong forming a pointed spike that is dissolvable in water.

22. A bar of soap, comprising:

a cake of solid surfactant material for washing, the cake having a flat side; and a stand for the cake, the stand comprising:

a base having an upper surface and an opposing lower surface;

a plurality of teeth placed along the upper surface of the base and extending into the cake through the flat side when the base is compressed against the flat side of the cake, the teeth holding the base to the cake; and a plurality of tabs placed along the lower surface of the base, wherein each of the plurality of tabs is dimensioned to support the base and the connected cake above a support surface;

wherein the bar of soap is coupled with the stand.

23. The bar of soap of claim 22, further comprising:

a plurality of through-openings formed through the base.

24. The bar of soap of claim 22, further comprising:

a dish dimensioned to receive the stand.

* * * * *